US007675234B2

(12) United States Patent
Fu et al.

(10) Patent No.: US 7,675,234 B2
(45) Date of Patent: Mar. 9, 2010

(54) PLASMA DISPLAY PANEL HAVING HONEYCOMB SUPPORTING STRUCTURES

(75) Inventors: Chung-Lin Fu, Jhubei (TW); Yu-Ting Chien, Yonghe (TW); Chun-Chien Chiu, Lujhu Township, Taoyuan County (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 1102 days.

(21) Appl. No.: 11/218,091

(22) Filed: Aug. 31, 2005

(65) Prior Publication Data

US 2007/0046200 A1 Mar. 1, 2007

(51) Int. Cl.
*H01J 17/49* (2006.01)

(52) U.S. Cl. ..... 313/582; 313/586; 313/587

(58) Field of Classification Search ..... 313/582–587
See application file for complete search history.

(56) References Cited

U.S. PATENT DOCUMENTS 6,855,026 B2 * 2/2005 Fujinaga et al. ..... 445/24
7,259,516 B2 * 8/2007 Wan et al. ..... 313/582
7,291,377 B2 * 11/2007 Ahn et al. ..... 428/120
7,397,188 B2 * 7/2008 Hong et al. ..... 313/583
7,443,099 B2 * 10/2008 Song et al. ..... 313/586
2003/0189405 A1 10/2003 Shirakawa et al. ..... 313/582
2004/0056597 A1 3/2004 Ko et al. ..... 313/582
2004/0091672 A1 * 5/2004 Ahn et al. ..... 428/156
2005/0140298 A1 * 6/2005 Chen et al. ..... 313/582
2005/0221713 A1 * 10/2005 Wan et al. ..... 445/66
2005/0242728 A1 * 11/2005 Song et al. ..... 313/583
2006/0091802 A1 * 5/2006 Hong et al. ..... 313/582
2006/0202619 A1 * 9/2006 Kim ..... 313/582
2007/0108902 A1 * 5/2007 Yim ..... 313/582

* cited by examiner

*Primary Examiner*—Bumsuk Won
(74) *Attorney, Agent, or Firm*—J.C. Patents

(57) ABSTRACT

A plasma display panel and a manufacturing method of barrier ribs thereof are provided. The plasma display panel is divided into a display area and a non-display area located in the periphery of the display area. When discharge space is formed in the display area by barrier ribs, a plurality of honeycomb supporting structures are formed in the non-display area at the same time. The honeycomb supporting structures can increase the yield factor of assembling the substrates, and then the display quality of the plasma display panels can be improved.

3 Claims, 4 Drawing Sheets

PLASMA DISPLAY PANEL HAVING HONEYCOMB SUPPORTING STRUCTURES

BACKGROUND OF THE INVENTION

1. Field of the Invention

The present invention generally relates to a display panel and a manufacturing method thereof. More particularly, the present invention relates to a plasma display panel and a manufacturing method of barrier ribs thereof.

2. Description of Related Art

Flat panel displays serve as a communication interface between human and computers. At present, the flat panel displays include plasma displays, organic electro-luminescent displays (OELD) and liquid crystal displays (LCD). Among them, plasma displays have such advantages as big size, self-illuminance, wide-view angle, thinness and full color, and thus have the potential of becoming the mainstream flat panel display product in its next generation.

In general, barrier ribs of a plasma display not only constitute discharging spaces in the display area of a panel, but also extend into the non-display area of the panel to assist the assembly of the front substrate and the rear substrate. FIG. 1A is a schematic partial vertical view of the conventional plasma display panel, and FIG. 1B is a cross sectional view taken along line A-A' in FIG. 1A. As shown in FIGS. 1A and 1B, the plasma display panel 100 is divided into a display area 104 and a non-display area 102 located in the periphery of the display area 104. Barrier ribs 130 constitute multiple rectangle discharge spaces 132 in the display area 104 above the rear substrate 120 and extend multiple stripe leads 140 into the non-display area 102 to support the structure after assembling the front substrate (not shown) and the rear substrate 120.

Early plasma display panels' lower resolution and broader barrier ribs allow the stripe leads to provide enough structural strength against the loading pressure when printing the fluorescent material layer in the discharge spaces. However, as modern display panels require higher resolution, the breadth of the barrier ribs has to be relatively decreased. The narrowed stripe leads may not provide enough structural strength and can be damaged by the loading pressure in printing. In addition, the stripe leads may undergo heterogeneous thermal expansion in the following sintering process due to regular thickness of the barrier ribs. As a result, as exemplified in FIG. 2, leads 140 are peeled off from the surface of rear substrate 120, and in FIG. 3, the surface of the stripe leads 140 is deformed.

In either of the situation, the front substrate and the rear substrate will not be able to fit during assembly since the stripe leads are deformed, and will result in crosstalk disturbance during display so the display quality will be reduced.

SUMMARY OF THE INVENTION

Accordingly, the present invention is directed to providing a plasma display panel and a manufacturing method of the barrier ribs thereof, which has honeycomb supporting structures in the non-display area to improve the yield factor of assembling the front substrate and the rear substrate as so to improve the display quality.

The present invention provides a plasma display panel, which is divided into a display area and a non-display area located in the periphery of the display area. The plasma display panel comprises a front substrate, a rear substrate, multiple barrier ribs, and multiple supporting ribs, wherein the front substrate and the rear substrate are parallel, and the barrier ribs are disposed between the front substrate and the rear substrate in the display area and constitute discharging spaces. In addition, the supporting ribs are disposed between the front substrate and the rear substrate in the non-display area and constitute a plurality of honeycomb supporting structures.

The present invention further provides a manufacturing method of barrier ribs of a plasma display panel. First, a substrate, divided into a display area and a non-display area located in the periphery of the display area, is provided. Next, when a patterned barrier material layer forms on the substrate, the layer further constitutes discharging spaces in the display area and a plurality of honeycomb supporting structures in the non-display area.

In conclusion, the plasma display panel and the manufacturing method of barrier ribs thereof in the present invention is directed to forming the honeycomb supporting structures in the non-display area while the discharging space is formed, wherein the honeycomb supporting structures can enhance the structural strength and prevent cracking, peeling, or bulging caused in conventional printing or sintering process so the yield factor of assembling the substrates can be improved.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
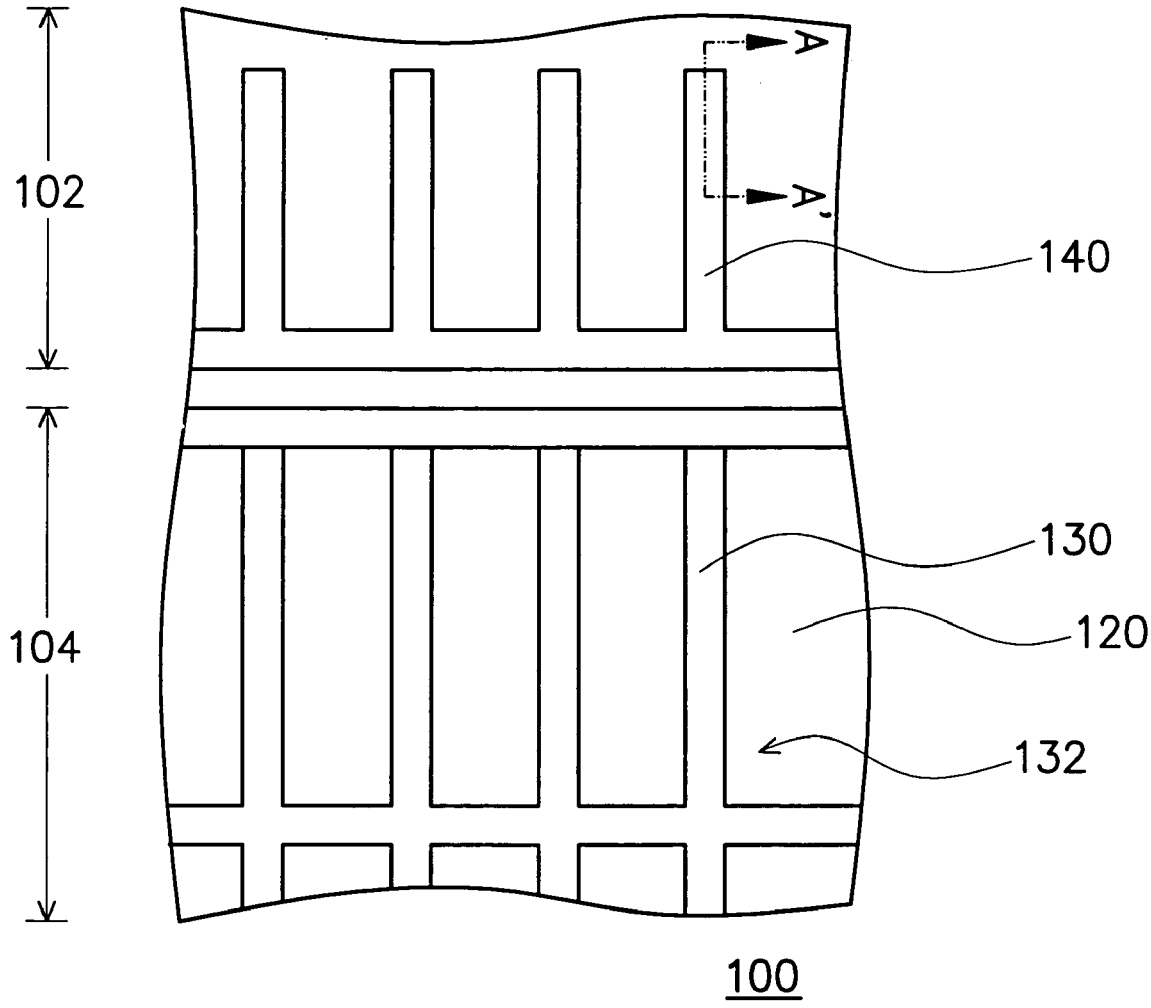
FIG. 1A (PRIOR ART)
FIG. 1A is a schematic partial vertical view of the conventional plasma display panel.
Figure 1B:
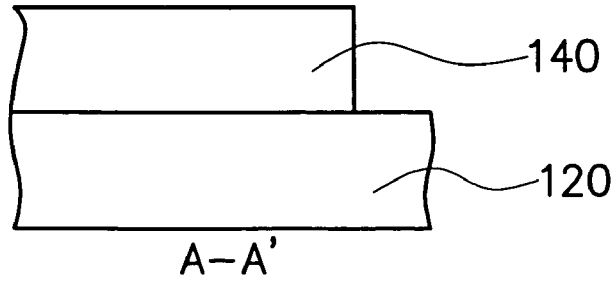
FIG. 1B (PRIOR ART)
FIG. 1B is a cross sectional view taken along line A-A' from FIG. 1A.
Figure 2:
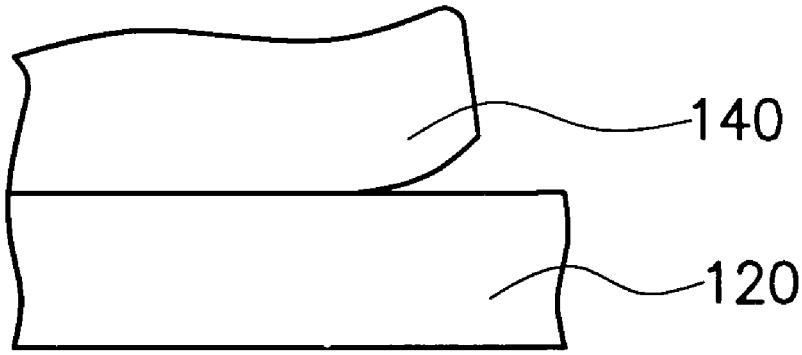
FIG. 2 (PRIOR ART)
FIG. 2 is a schematic drawing illustrating the stripe leads peeling off the rear substrate shown in FIG. 1B.
Figure 3:
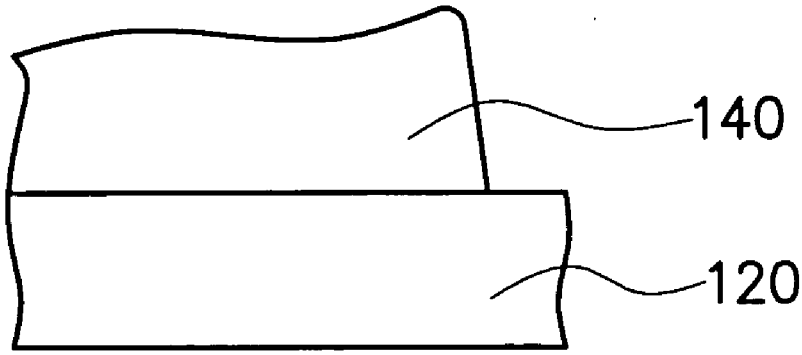
FIG. 3 (PRIOR ART)
FIG. 3 is a schematic drawing illustrating the bulged stripe leads shown in FIG. 1B.

Reference will now be made in detail to the present preferred embodiments of the invention, examples of which are illustrated in the accompanying drawings. Wherever possible, the same reference numbers are used in the drawings and the description to refer to the same or like parts.

Figure 4:
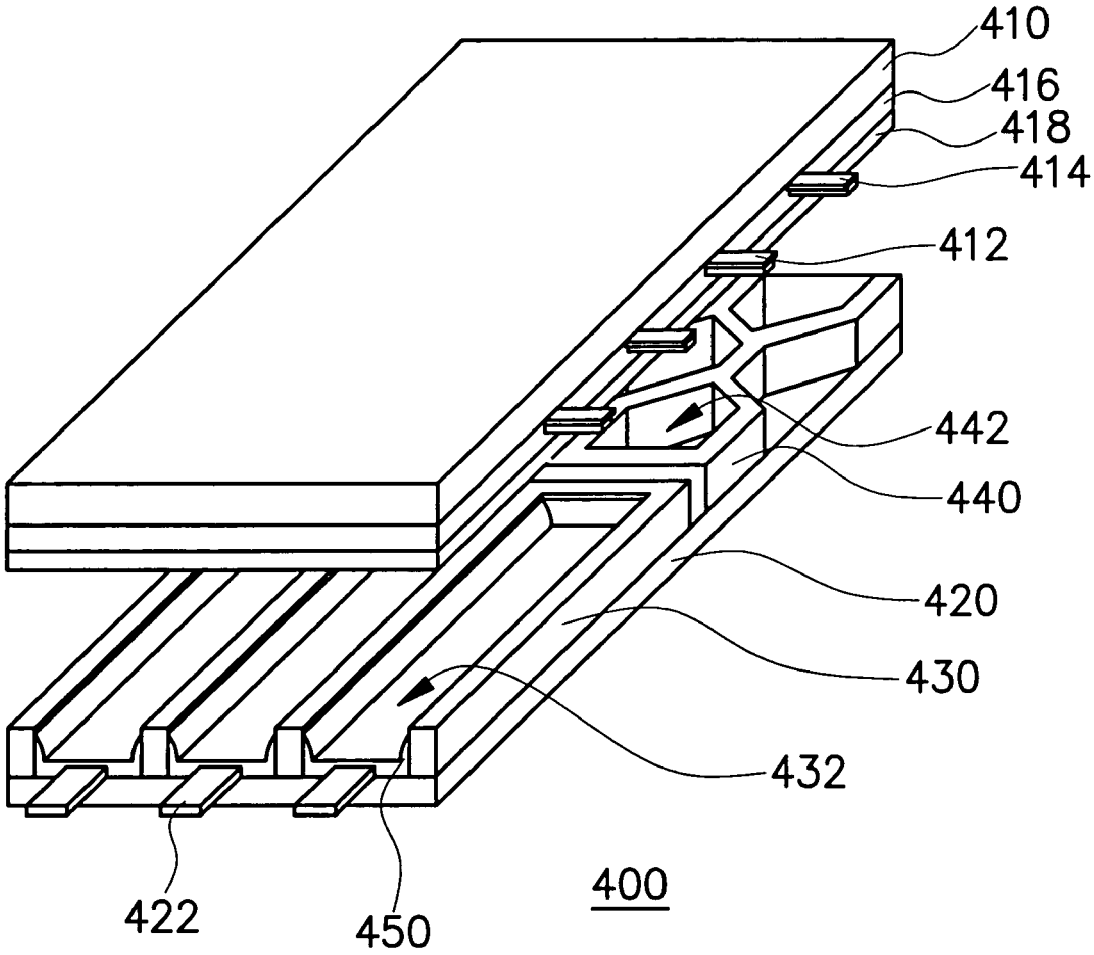
FIG. 4 is a partial perspective view of a plasma display panel in accordance with one embodiment of the present invention.

FIG. 4 is a partial perspective view of the plasma display panel in the present invention. As shown in FIG. 4, the plasma display 400 comprises a front substrate 410, a rear substrate 420, scan electrodes 412, sustain electrodes 414, address electrode 422, barrier ribs 430, and supporting ribs 440. The scan electrodes 412 and the sustain electrodes 414 are disposed in pairs in the front substrate 410 and are covered with a dielectric layer 416 and a passivation layer 418, which is made of MgO. In addition, the address electrodes 422, the barrier ribs 430, and the supporting ribs 440 are disposed in the rear substrate 420, wherein the barrier ribs 430, the front substrate 410 and the rear substrate constitute discharging spaces 432. Each discharging space 432 is filled with discharge gas (not shown). The supporting ribs 440 constitute a plurality of honeycomb supporting structures 442 between the front substrate 410 and the rear substrate 420. Besides, the discharging spaces 432 is covered with a fluorescent material layer 450, and the scan electrodes 412 and the sustain electrodes 414 is crisscrossed by the address electrodes 422 at the discharging spaces 432. When voltages are applied to the scan electrodes 412, the sustain electrodes 414 and the address electrodes 422, the discharging gas discharges and emits ultraviolet light to illuminate the fluorescent material layer 450 and eventually lights up the plasma display panel 400.

Figure 5:
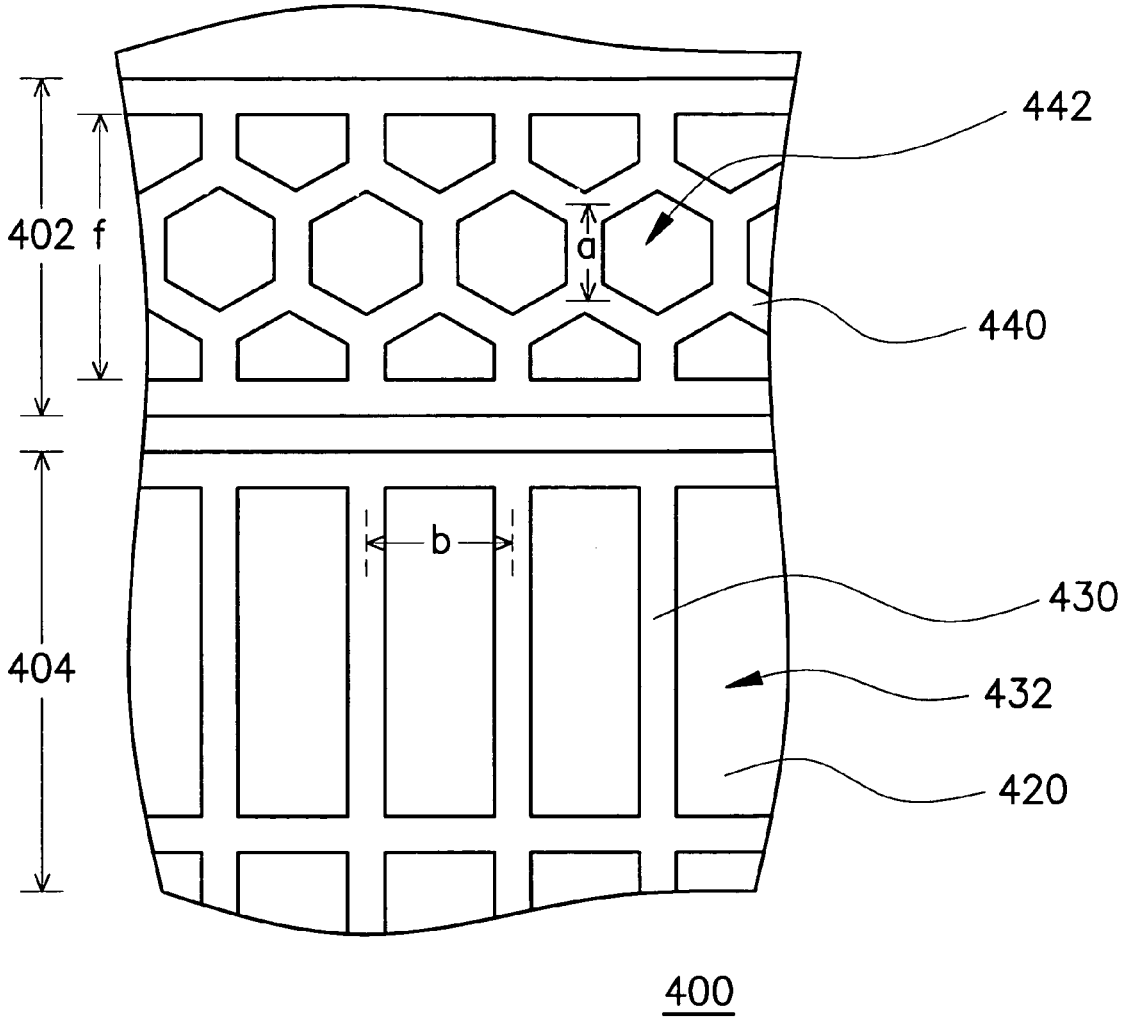
FIG. 5 is a schematic vertical view of the plasma display panel shown in FIG. 4.

FIG. 5 is a schematic vertical view of the plasma display panel described above. To better describe the characteristics in the present invention, the front substrate including scan electrodes and sustain electrodes, and the address electrodes on the rear substrate are not shown in FIG. 5.

As shown in FIG. 5, the plasma display panel 400 is divided into a display area 404 and a non-display area 402, which is located in the periphery of the display area 404. The barrier ribs 430 and the supporting ribs 440 are disposed in the display area 404 and the non-display area 402 respectively. The barrier ribs 430 constitute discharging spaces 432, and the supporting ribs 440 constitute a plurality of honeycomb supporting structures 442. In an embodiment of the present invention, the method of manufacturing the barrier ribs 430 and supporting ribs 440 starts when the barrier material layer (not shown) in the rear substrate 420 takes shape. Then, a sandblasting process is performed on the barrier material layer inside a mask made of patterned photoresist layer (not shown). This is to constitute the barrier ribs 430 in the display area 404 and supporting ribs 440 in the non-display area 402 simultaneously. In another embodiment of the present invention, the barrier ribs 430 and the supporting ribs 440 can also be formed in the rear substrate 420 by multiple steps of screen printing. Furthermore, in still another embodiment of the present invention, the patterned photoresist layer is formed on the rear substrate 420, and then the barrier ribs 430 and the supporting ribs 440 will be formed in an additive process in the region exposed by the patterned photoresist layer.

As shown in FIG. 5, the supporting structure of the present invention can be modified according to the design parameters, such as resolution, of various panels. The relative dimensions of the supporting structure will be illustrated in the following paragraph by an example. Wherein, the length of the supporting structure 442 is a, the length of the short side of the discharging space 432 is b, and the width of the non-display area 402 is f. referring to FIG. 5, the supporting structure 442 is formed with the barrier ribs 430 extending outward the display area 404, and the included angle between two adjacent supporting ribs 440 is about 120 degrees. According to the foregoing geometric relation, $a=b/\sqrt{3}$. In addition, the width f of the non-display area 402 is related to the length a of the supporting structure 442. If the number of the supporting structure 442 is fixed, then the length a of the supporting structure 442 is proportional to the width f of the non-display area 402. In other words, if the length a of the supporting structure 442 is fixed, then the number of the supporting structure 442 is proportional to the width f of the non-display area 402. For example, in the embodiment shown in FIG. 5, f=4a. The following table lists practical values of the aforementioned geometric parameters according to plasma display panels with various resolutions.

| Dimension | 46 inch | 46 inch | 50 inch |
|---|---|---|---|
| Resolution | 852*480 | 1280*768 | 1366*768 |
| a (um) | 227.5 | 151.8 | 147.2 |
| b (um) | 394 | 263 | 255 |
| f (um) | 909.9 | 607.4 | 588.9 |

As shown in FIG. 5, different from the conventional design of stripe leads, the present invention provides multiple supporting structures 442 in the non-display area 402, wherein the supporting structures 442 resemble the shape of a honeycomb. Because every two adjacent supporting ribs 440 have an included angle of approximately 120 degrees, each supporting rib 440 will receive the same loading pressure applied to the supporting structures 442 to achieve better structural strength. Therefore, the peeling or bulging of the supporting ribs 440 can be avoided in the following sintering process. In addition, the probability of the supporting structures 442 cracking up by loading pressure when forming the fluorescent material layer or undergoing other following process can also be prevented.

The main character of the present invention is directed to changing the conventional design of the stripe leads to the honeycomb supporting structures to improve the structural strength. It should be noted that although the embodiment of the present invention provides the honeycomb structures, in practice, the supporting structures can also be a rectangle, triangle, or multilateral closed structure to provide substantial improvement of structural strength. And changes in length, width, or thickness can also be made for the best result.

To sum up, the plasma display panel and the manufacturing method of the barrier ribs thereof in the present invention is directed to forming the honeycomb supporting structures in the non-display area to provide better structural strength and avoid cracking, peeling, or bulging in the manufacturing process of prior art. Therefore, the yield factor of assembling the front substrate and the rear substrate can be improved and the crosstalk disturbance due to uneven assembly of the substrates can also be prevented for better display quality.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A plasma display panel, divided into a display area and a non-display area located in the periphery of the display area, comprising:

a front substrate;

a rear substrate, parallel to the front substrate;

multiple barrier ribs, disposed between the front substrate and the rear substrate in the display area, wherein the barrier ribs constitute discharging spaces in the display area, wherein a length of a short side of each of the discharging space is b; and multiple supporting ribs, disposed between the front substrate and the rear substrate in the non-display area, wherein the supporting ribs constitute a plurality of honeycomb supporting structures in the non-display area, a length of each of the plurality of honeycomb supporting structures being a, a width of the non-display area being f, wherein $a=b/\sqrt{3}$, and f=4a, wherein the discharging spaces are in the shape of a rectangle or a stripe.

2. The plasma display panel of claim 1, wherein the barrier ribs and the supporting ribs are formed as a whole.

3. The plasma display panel of claim 1, wherein an angle between two adjacent supporting ribs is 120 degrees.

* * * * *